US006357805B1

(12) United States Patent
Hebda

(10) Patent No.: US 6,357,805 B1
(45) Date of Patent: Mar. 19, 2002

(54) DEVICE FOR OPERATING A DOOR LATCH

(76) Inventor: Thomas J. Hebda, 539 S. Park Rd., Lombard, IL (US) 60148

( * ) Notice: Subject to any disclaimer, the term of this patent is extended or adjusted under 35 U.S.C. 154(b) by 0 days.

(21) Appl. No.: 09/397,268

(22) Filed: Sep. 16, 1999

(51) Int. Cl.[7] ..... E05C 1/06

(52) U.S. Cl. ..... 292/144; 292/1; 49/280; 49/301

(58) Field of Search ..... 49/280, 289, 301, 49/297; 292/1, 144, 201, DIG. 12, DIG. 25

(56) References Cited

U.S. PATENT DOCUMENTS 822,129 A * 5/1906 Huitt et al. ..... 49/301 X
898,865 A * 9/1908 Galarneau et al.
959,615 A * 5/1910 Schurrmacher ..... 49/301 X
1,328,979 A * 1/1920 Becker ..... 49/301
1,674,662 A * 6/1928 Rowntree ..... 49/280
5,095,654 A * 3/1992 Eccleston ..... 49/280

* cited by examiner

*Primary Examiner*—Teri Pham Luu
(74) *Attorney, Agent, or Firm*—Robert L. Marsh

(57) ABSTRACT

A device is provided for unlatching a door which is latched into a door frame where the door latch assembly includes an elongate lever arm rotatable about an axis from a first latched orientation to second unlatched orientation. The device includes a cable having a first end attachable to the distal end of the lever arm and a second end attached to a take up spool. The take up spool is rotated by a motor in a first direction to take up the cable and thereby draw the lever arm from the first latched orientation to the second unlatched orientation and thereafter rotate in the second direction to release the cable and allow the lever arm to return from the second unlatched orientation to the first latched orientation.

15 Claims, 3 Drawing Sheets

DEVICE FOR OPERATING A DOOR LATCH

The present invention relates to door opening devices and, in particular, to a device for releasing the latch on a latched door so that the door can be moved from the closed position to the open position without interference from the latch.

BACKGROUND OF THE INVENTION

In my prior U.S. Pat. No. 5,634,296 I disclosed a device which can be connected between a door and a wall for opening and closing the door. Although the device will reliably move the door between an open position and a closed position, where the door has a latch, the door must also be fitted with some form of latch release. Existing latch releases operate by releasing the latch plate in the wall. Although such latch releases work effectively, they are difficult to install because costly modifications are needed to accommodate the releasable latch plate, and the release solenoid draws conventional AC power such that the device must be wired into the electrical system of the structure.

It would be desirable to provide a latch release device which would not require modifications to the door frame and that would not have to be connected into the AC electric system servicing the structure.

SUMMARY OF THE INVENTION

Briefly, the present invention is embodied a device for unlatching a door which is latched into a door frame where the door latch assembly includes an elongate lever arm rotatable about an axis from a first latched orientation to a second unlatched orientation. The device is attachable to the door and includes a cable having a first end attachable to the distal end of the lever arm and a second end attached to a take up spool. The take up spool is rotated by a motor in a first direction to take up the cable and thereby draw the lever arm from the first latched orientation to the second unlatched orientation and thereafter rotate in the second direction to release the cable and allow the lever arm to return from the second unlatched orientation to the first latched orientation.

The device includes a first detector for detecting when the spool has rotated in a first direction until the lever arm has been drawn to the second orientation, a second detector for detecting when the spool has rotated in the second direction until the lever arm has returned to the first orientation, a third detector for detecting when the door has moved out of the frame, and a start means for starting the unlatching sequence. A logic, which may be in the form of a microprocessor, is responsive to the first detector, the second detector, the third detector, and the start means and directs power to the motor for rotating the spool in the first direction upon actuation of the start means, terminates power to the motor to stop rotation of the spool in the first direction upon receipt of a signal from the first detector, commences power to the motor to rotate the spool in the second direction upon receipt of the signal from the third detector, and terminates power to the motor to stop rotation of the spool upon receipt of a signal from the second detector.

In the preferred embodiment, the first and second detectors comprise cams mounted on the shaft of the spool which engage associated limit switches. The third detector may be any of a number of known devices for detecting when a door has moved out of a closed position, includes detectors associated with door opening devices or a device for assisting in moving a door from a closed orientation to an ajar orientation as disclosed in my patent application filed on Jul. 28, 1999 as Ser. No. 09/362,248.

BRIEF DESCRIPTION OF THE DRAWINGS

A better understanding of the present invention will be had after a reading of the following detailed description taken in conjunction with the drawings wherein.

DETAILED DESCRIPTION OF THE PREFERRED EMBODIMENT

Figure 1:
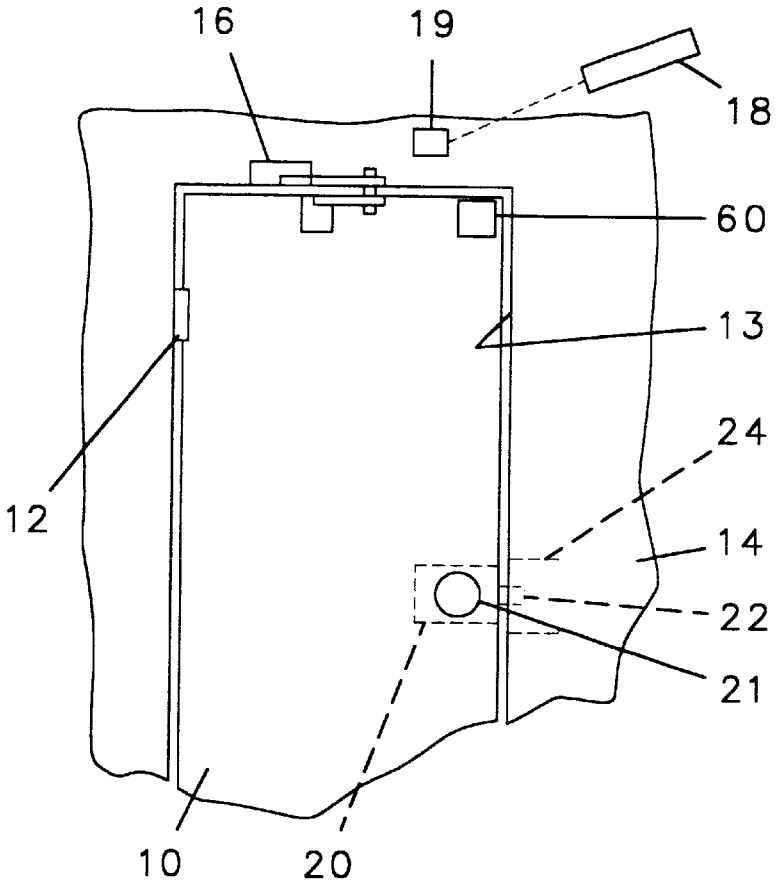
FIG. 1 is a fragmentary front elevational view of a door having a door opening device fitted thereon.

Referring to FIG. 1, a door 10 pivots about the axis of pins 12 of hinges to open and closed against a frame 13 which defines the opening in a wall 14. A door operating device 16 attached to the upper end of the door 10 and to the wall 14 is operated by a start button 18, which may be an infrared transmitter that sends a signal to a receiver 19 connected to the device 16. The door is retained in a closed position by a latch 20 having a bolt 22 which extends into a latch plate 24.

Typically, the latch 20 is fitted with a door knob 21, which is turned to rotate a key 23 (shown in FIG. 2) from a standby orientation in which the bolt 22 extends from the latch 20 to an unlatch orientation in which the bolt is withdrawn into the latch 20. The latch 20 includes a spring 25 (shown in FIG. 2), which urges the bolt axially outward of the latch 20 and urges the key 23 and any object attached thereto to rotate towards the standby orientation. To open the door 10 an operator rotates the door knob 21 and key 23 to withdrawn the bolt 22 from the latch plate 24, after which the door 10 is free to pivot about the pins 12 of the hinges. When the door knob is released, the spring 25 in the latch rotates the key 23 and the connected door knob back to the stand by orientation and urges the bolt 22 axially outward to the latching position.

Figure 2:
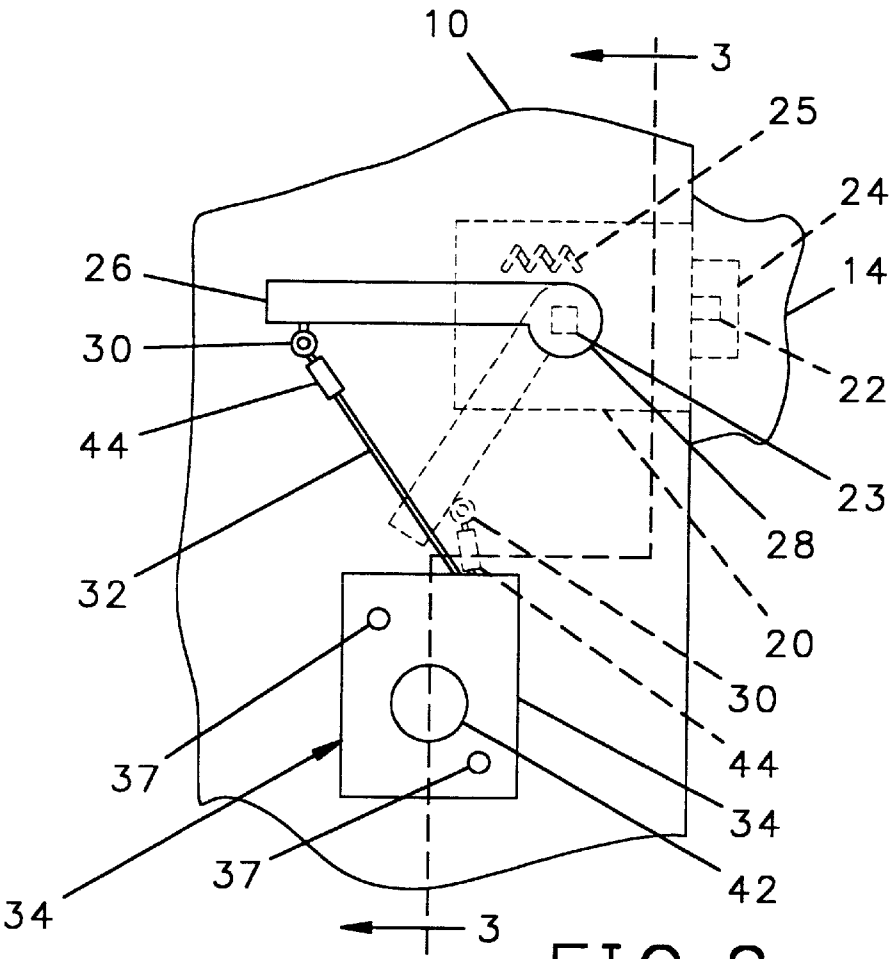
FIG. 2 is a fragmentary enlarged front elevational view of the door of FIG. 1 with an unlatching device in accordance with the invention fitted thereon.
Figure 4:
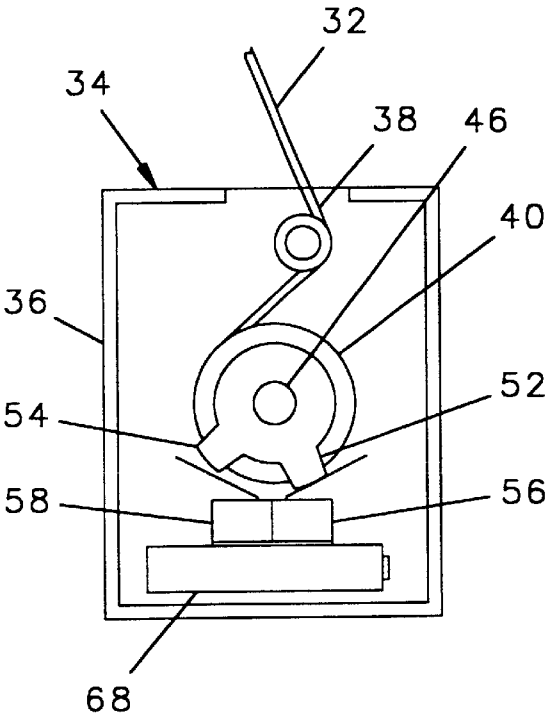
FIG. 4 is a cross-sectional view of the unlatching device taken through line 4—4 of FIG. 3.
Figure 3:
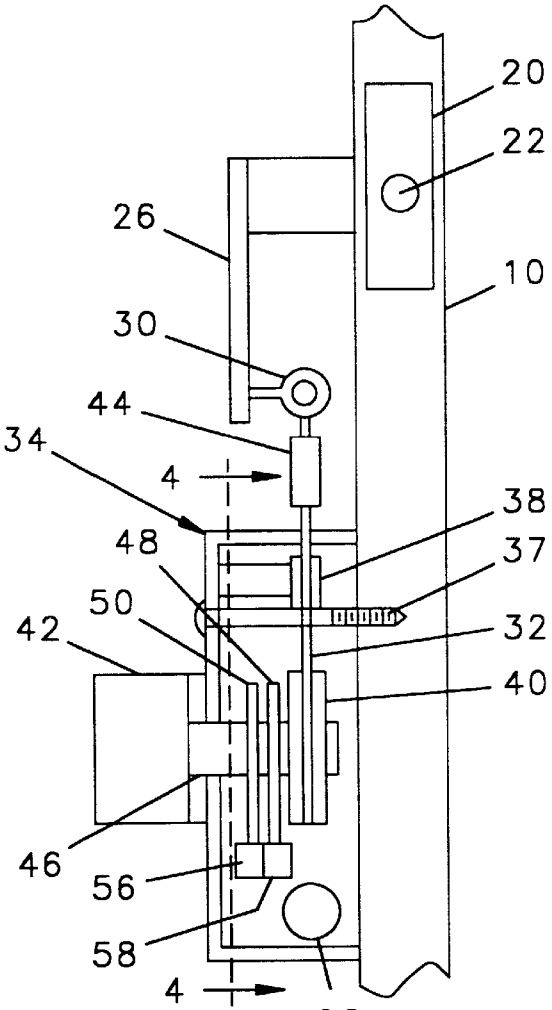
FIG. 3 is a side cross-sectional view of the unlatching device shown in FIG. 2 taken through line 3—3 of FIG. 2.

Referring to FIGS. 2–4, in accordance with the present invention, the door knob 21 is removed and is replaced by a lever 26 having a mounting portion 28 which receives the key 23 extending from the latch 20 for operating the bolt 22. An eye bolt 30 is mounted to the distal end of the lever 26 for receiving one end of a cable 32, the other end of which is connected to an unlatching device 34 in accordance with the present invention.

The unlatching device 34 has a housing 36 attached to the door 10 by any suitable means such as devices 37, and in the housing 36 is an idler pulley 38 around which the cable 32 is wrapped, and a take up spool 40 to which the second end of the cable 32 is attached. A DC gear motor 42 on the exterior of the housing 36 rotates the take up spool 40 counter clockwise, as viewed in FIG. 4, to take up the cable 32 and draw the lever 26 from a latched orientation, as shown in solid lines in FIG. 2, to an unlatched orientation, as shown in broken lines, and rotates the spool 40 in a clockwise direction to release the lever 26 and allow it to return to the latched position. A spring 44 connected between the eye bolt 30 and the cable 32 absorbs shock within the cable 32 to protect the parts from damage when the motor commences or terminates the rotation of the take up spool 40. As can be seen, the circumference of the spool 40 must be sufficiently large to wrap a length of cable 32 sufficiently long to draw the lever 26 to an unlatched orientation where the bolt 22 is withdrawn from the plate 24.

Referring to FIGS. 3 and 4, a shaft 46 extends from the gear motor 42 through the housing 36 to which the take up spool 40 is attached. Fitted around a portion of the shaft 46 are first and second annular cam members 48, 50 having cam lobes 52, 54 respectively. The cam lobes 52, 54 interact with limit switches 56, 58 respectively which are attached to the housing 36. The cam members 48, 50 each have a central opening sized to fit tightly around the shaft 46 such that the cams will rotate with the shaft 46 during the normal operation of the device, but can be manually rotated with respect to the shaft to alter the positions at which the cam lobes 52, 54 engage the limit switches 56, 58. When properly adjusted, cam lobe 52 will actuate limit switch 56 when the take up spool 40 is rotated counter clockwise until the lever handle 26 is drawn into the unlatched orientation shown in broken lines on FIG. 2. Similarly, cam lobe 54 will engage limit switch 58 when the take up spool is subsequently rotated clockwise until the lever handle 26 has returned to the latched position shown in solid lines. Cam 48 with lobe 52 and limit switch 56 is, therefore, a first detector for detecting when the level 26 has reached the unlatched orientation and cam 50 with lobe 54 and switch 58 is a second detector for detecting when the lever 26 has returned to the latched orientation.

The device 34 further includes a third detector for detecting whether the door 10 is within the frame 13. The third detector may be a part of the door operating device 16, or of a supplemental device which will urge the door 10 from the closed position to an ajar position as disclosed in my patent application filed on Jul. 28, 1999 and assigned Ser. No. 09/362,248.

Figure 6:
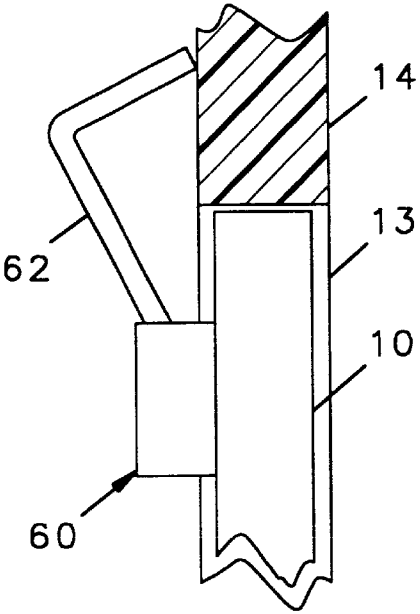
FIG. 6 is a side view of the third detector shown in FIG. 5 with the door in the closed condition.
Figure 5:
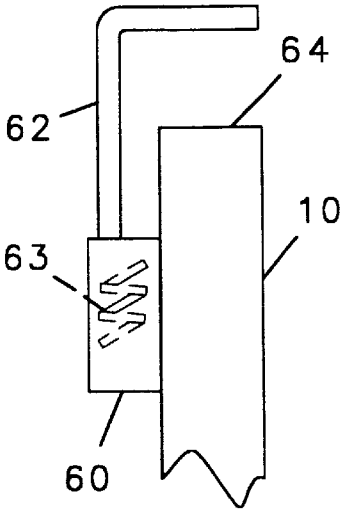
FIG. 5 is a side view of a third detector mounted on a door which is in the open condition.

Referring to FIGS. 1, 5 and 6, the third detector may also be a free standing device such as switch 60 and a hook-shaped pivotable arm 62 for actuating the switch 60. The arm 62 is urged by a spring 63 toward a first orientation in which the distal end thereof extends around the edge 64 of the door 10 as shown in FIG. 5. When the door 10 is closed into the opening 13 in a wall 14, the distal end of the arm 62 contacts the wall 14 and pivots the arm to a second orientation shown in FIG. 6, thereby actuating the switch 60. The switch 60 is activated when the door 10 is closed in the frame 13 and is deactivated when the door 10 moves out of the frame 13, such that switch 60 is a third detector.

Figure 7:
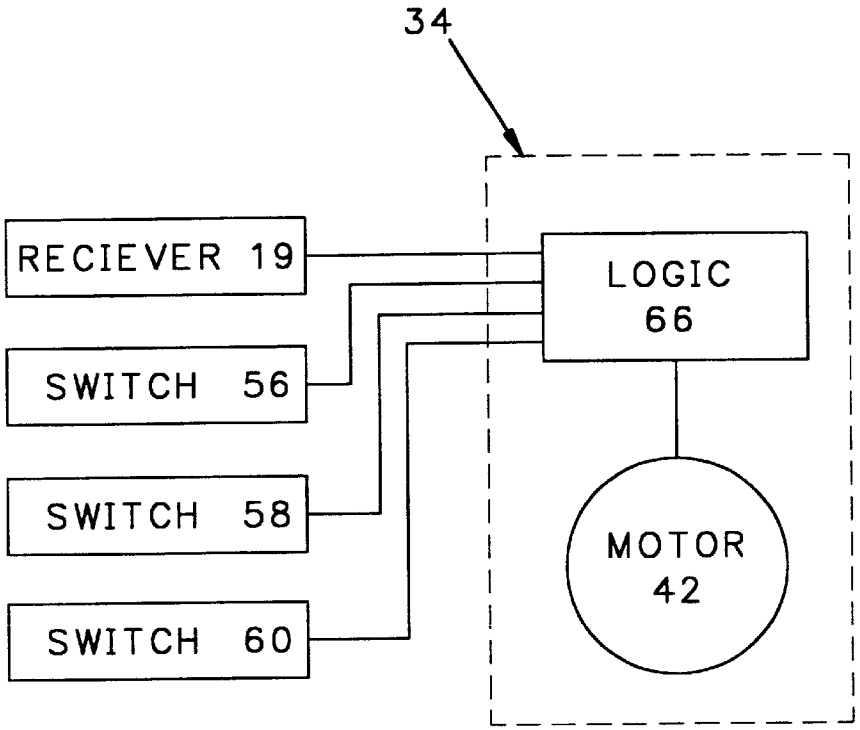
FIG. 7 is a block diagram of the circuit for the unlatching device shown in FIG. 2.

Referring to FIG. 7, the device further includes a logic 66 which may be a microprocessor. The logic 66 is connected to receive signals from the first switch 56, the second switch 58, the third switch 60, the receiver 19 of the door operating device 16, and it controls the direction of electric power to the DC gear motor 42. When the door is closed and the logic 66 receives a signal from the receiver 19 that the start button 18 has been depressed, the logic 66 will direct power to the gear motor 42 to rotate the take up spool 40 counter clockwise, thereby pulling the cable 32 and drawing the lever 26 downward. The logic 66 continues to direct power to the gear motor 42 until the second limit switch 58 is actuated by the cam 50 at which time the lever arm has reached the second orientation shown in broken lines in FIG. 2. The bolt 22 has then been withdrawn from the plate 24, leaving the door unlatched, and the door operating device 16 can move the door 10 out of the frame 13. As the door moves out of the frame 13, the spring 63 returns the arm 61 to the orientation shown in FIG. 5. When the logic 66 receives a signal from the third switch 60 that the door 10 has moved out of the frame 13, it again directs electric power to the gear motor 42, this time in the reverse polarity causing the take up spool 40 to rotate in the clockwise direction to unwrap the cable 32. As the cable 32 is unwrapped, the spring in the latch 20 urges the key 23 and the lever 26 attached thereto to rotate clockwise back towards the standby orientation. The motor 42 continues to rotate in a clockwise direction until lobe 54 on cam 50 interacts with the second limit switch 58, which occurs when the lever 26 has returned to the latched orientation shown in solid lines in FIG. 2. When the logic 66 receives a signal from the limit switch 58, it will terminate power to the gear motor 42, thereby returning the device 34 to the standby position.

The operation of the device 34 is commenced only upon receipt of a signal from the receiver 19 and therefore it does not cycle when the door is subsequently closed into the frame 13. Since the cable 32 does not interfere with the rotation of the lever 26 it does not interfere with the manual operation of the door latch 20. Also, the device 34 does not draw substantial amounts of power so it can be operated by simple batteries 68 mounted within the housing 36 thereby simplifying the attachment of the device 34 to the door 10.

There has therefore been disclosed a door unlatching device which can unlatch a door prior to being opened by door opener without requiring alterations to the door frame or the connection of the device into the electrical system of the structure.

While the present invention has been described with respect to a single embodiment, it will be appreciated that many modifications and variations can be made without departing from the true spirit and scope of the invention. It is therefore the intent of the following claims to cover all such modifications and variations which fit within the true spirit and scope of the invention.

What is claimed:

1. A device for operating a door latch having a bolt moveable from a latched position to an unlatched position by rotating a key from a first orientation to a second orientation, said device comprising attachment means for attaching said device to said key, a motor, start means for directing power to said motor, and turning means connected to said motor for turning said key from said first orientation to said second orientation, detector means for detecting when said key has been rotated to said second orientation, and said turning means is response to a signal from said detector means.

2. The device of claim 1 wherein said latch includes a spring for urging the rotation of said key towards said first orientation and said device further comprises second detector means for detecting when said door has moved out of a door frame, and logic means connected to said motor and said second detector means for releasing said turning means and allowing said spring to return said key to said first orientation after said door has moved out of said door frame.

3. The device of claim 2 wherein said attachment means includes a lever, said turning means includes a spool and a cable having a first and a second end, said first end of said cable is attached to said lever, said second end of said cable is attached to said spool, and said motor rotates said spool to rotate said key from said first orientation to said second orientation.

4. The device of claim 2 and further comprising third detector means for detecting when said key has returned to said first orientation, and said logic means is connected to said third detector means for terminating power to said motor after said devices has returned to a standby condition.

5. The device of claim 4 and wherein said attachment means includes a lever, said turning means includes a spool and a cable having a first end and a second end, said first end of said cable is attached to said lever, said second end of said cable is attached to said spool, and said motor rotates said spool to rotate said key from said first orientation to said second orientation.

6. A device for attachment to a door having a door latch having a bolt moveable from a latched position to an unlatched position by rotating a handle from a first orientation to a second orientation, said device comprising first attachment means for attaching device to said handle, second attachment means for attaching said device to said door, a motor, start means for directing power to said motor, turning means connected to said motor for turning said handle from said first orientation to said second orientation, detector means for detecting when said handle has been rotated to said second orientation, and said turning means is responsive to a signal from said detector means.

7. The device of claim 6 and further comprising a lever handle for replacing a knob handle on said door, and said turning means having a cable one end of which is connected to one end of said lever handle.

8. The device of claim 7 wherein said turning means further comprises a ratable spool, and said cable has a second end connected to said spool.

9. The device of claim 6 wherein said latch includes a spring for urging the rotation of said handle towards said first orientation and said device further comprises second detector means for detecting when said door has moved out of door frame, and logic means connected to said motor and said second detector means for releasing said turning means and allowing said spring to return said handle to said first orientation after said door has moved out of said door frame.

10. The device of claim 9 wherein said attachment means includes a lever, said turning means includes a spool and a cable having a first and a second end, said first end of said cable is attached to said lever, said second end of said cable is attached to said spool, and said motor rotates said spool to rotate said key from said first orientation to said second orientation.

11. The device of claim 10 and further comprising third detector means for detecting when said key has returned to said first orientation, and said logic means connected to said third detector means for terminating power to said motor after said devices has returned to a standby condition.

12. The device of claim 11 and wherein said attachment means includes a lever, said turning means includes a spool and a cable having a first end and a second end, said first end of said cable is attached to said lever, said second end of said cable is attached to said spool, and said motor rotates said spool to rotate said key from said first orientation to said second orientation.

13. A kit for unlatching a door latched into a door frame so that said door may be moved out of said frame, said door having a latch assembly with a handle rotatable about an axis from a first latched orientation to a second unlatched orientation, the kit comprising;

a door unlatching device having a housing, means for attaching said housing to said door, a cable having a first end and a second end, means for attaching said first end of said cable to said handle, a take up spool in said housing, said second end of said cable connected to said take up spool, a motor in said housing for rotating said take up spool in a first direction and in a second direction, a first detector for detecting when said handle is in said first orientation, a second detect or for detecting when said handle is in said second orientation, a start means for starting said motor when said door is to be unlatched, a third detector for detecting when said door is out of said door frame, and logic means responsive to said start means, said first detector, said second detector, and said third detector for directing power to said motor to rotate said spool in said first direction upon actuation of said start means, to terminate power to said motor to stop rotation in said first direction upon receipt of a signal from said second detector, to commence power to said motor for rotation of said spool in said second direction upon receipt of a signal from said third detector, and for terminating power to said motor to stop rotation of said spool in said second direction upon receipt of a signal from said first detector.

14. The kit of claim 13 and further comprising a lever handle for replacing a knob type handle on said door.

15. A device for unlatching a door moveable between a closed position in which said door is in a frame and an open position, in which said door is outside said frame, said door retained in said closed position by a latch having a bolt extended into a latch plate in said frame, said device for withdrawing said bolt from said latch plate by rotating a handle from a first position in which said bolt is extended to a second position in which said bolt is withdrawn, said handle being spring loaded to return from said second position to said first position, said device comprising means for attaching said device to said door, a cable having a first end and a second end, means for attaching said first end of said cable to said handle wherein taking up said second end of said cable will rotate said handle, a spool, said second end of said cable attached to said spool, and a motor drivingly attached to said spool wherein operation of said motor will rotate said spool to take up said cable and rotate said handle.

* * * * *

UNITED STATES PATENT AND TRADEMARK OFFICE

CERTIFICATE OF CORRECTION

PATENT NO. : 6,357,805 B1
DATED : March 19, 2002
INVENTOR(S) : Thomas J. Hebda

It is certified that error appears in the above-identified patent and that said Letters Patent is hereby corrected as shown below:

Column 3,
Line 39, add, -- now patent No. 6,067,753 issued May 30, 2000 --.

Column 4,
Line 56, after “is” delete “response” and substitute -- responsive. --.

Column 5,
Line 47, after “comprises a” delete “ratable” and substitute -- rotatable. --.

Signed and Sealed this

Thirtieth Day of July, 2002

*Attest:*

*Attesting Officer*

JAMES E. ROGAN
*Director of the United States Patent and Trademark Office*